US006095359A

United States Patent [19]

Richmond

[11] Patent Number: 6,095,359

[45] Date of Patent: Aug. 1, 2000

[54] MOLDED PLASTIC CONTAINER CLOSURE WITH FULLY EMBEDDED BARRIER

[75] Inventor: Thomas Michael Richmond, Evansville, Ind.

[73] Assignee: RXI Plastics, Inc., Triadelphia, W. Va.

[21] Appl. No.: 09/405,614

[22] Filed: Sep. 24, 1999

[51] Int. Cl.[7] ..... B65D 53/00

[52] U.S. Cl. ..... 215/341; 215/329; 215/350

[58] Field of Search ..... 215/329, 341, 215/349, 350; 220/288, 304, 378

[56] References Cited

U.S. PATENT DOCUMENTS

| | | | |
|---|---|---|---|
| 3,458,077 | 7/1969 | Ryan | 215/350 X |
| 3,826,395 | 7/1974 | Montgomery . | |
| 3,933,267 | 1/1976 | Rohde | 215/350 |
| 4,378,893 | 4/1983 | Wilde et al. | 215/350 X |
| 4,407,422 | 10/1983 | Wilde et al. | 215/350 X |
| 4,648,520 | 3/1987 | Stull . | |
| 4,674,642 | 6/1987 | Towns et al. . | |
| 4,721,221 | 1/1988 | Barriac . | |
| 4,862,928 | 9/1989 | Breuer et al. | 215/350 |
| 5,289,932 | 3/1994 | Dimeo et al. . | |
| 5,356,021 | 10/1994 | McBride et al. | 215/350 X |
| 5,462,187 | 10/1995 | Gregory et al. | 215/350 |
| 5,615,789 | 4/1997 | Finkelstein et al. . | |

*Primary Examiner*—Stephen K. Cronin
*Attorney, Agent, or Firm*—Richard V. Westerhoff; Eckert Seamans Cherin & Mellott, LLC

[57] ABSTRACT

A plastic closure has a gas impermeable barrier member co-extruded with and substantially fully embedded within the cap so that the barrier member is mechanically captured within the molded cap. The substantially fully embedded barrier member extends at least across the end wall and can also extend circumferentially within and at least partially axially down the skirt from the end wall.

6 Claims, 2 Drawing Sheets

MOLDED PLASTIC CONTAINER CLOSURE WITH FULLY EMBEDDED BARRIER

BACKGROUND OF THE INVENTION

1. Field of the Invention

This invention relates to plastic closures for containers and particularly to such closures having a barrier layer embedded in the plastic.

2. Background Information

Many food products are placed in containers and sealed by a closure while the product is still at a temperature which will kill bacteria. As the product cools, it is common for a vacuum to be created inside the sealed container. If plastic closures are used which are not gas impermeable, air can be drawn into the container which contaminates the product if it is oxygen or a nitrogen sensitive. In addition, even products which are not hot filled can be contaminated by air or water vapor if the closure is not gas impermeable. In addition to food products, this can include pharmaceuticals, for instance. There are also products such as carbonated beverages and products incorporating solvents such as paint or other aggressive chemical products such as insecticides and herbicides in which it is deleterious to have gases or vapors permeate through the plastic closure. There is also a need to prevent the deterioration of aromatic products such as cosmetics through plastic closures which do not block transmission of the vapors.

It is common to include a separate liner within a plastic closure. It is also known to provide seals over a container opening. However, the latter only protects the product prior to the initial opening of the container and removal of the seal.

There is a need, therefore, for improvement in molded plastic closures for hot fill products, gas sensitive products and vapor gas-producing products.

SUMMARY OF THE INVENTION

Such improvements are provided by the invention which is directed to a closure which includes a molded plastic cap having an end wall and a skirt extending axially from a periphery of the end wall. A gas/vapor impervious barrier member extends at least across and is fully embedded within the end wall. By fully embedded, it is meant that the barrier member is substantially surrounded all around by the molded plastic of the cap. Preferably, the barrier member extends radially outward beyond the inner surface of the skirt which has container engaging members such as threads which engage corresponding members on the neck of the container. Thus, the barrier member extends fully over the opening in the container. Even in this preferred embodiment the barrier remains substantially fully embedded within the molded plastic of the cap.

In another embodiment of the invention, the barrier member also extends circumferentially within and at least partially axially along the skirt from the end wall with this extension also substantially fully embedded within the skirt.

Also preferably, the cap and the barrier member are co-injection molded with the barrier member being molded of a material selected from a group comprising: polyvinylidene chloride copolymer (PVDC), ethylene vinyl alcohol copolymer (EVOH), ethylene vinyl acetate (EVA), and nylon while the cap end wall and skirt are molded of a material selected from a group comprising polypropylene, high density polyethylene, polyethylene terephthalate (PET), and styrene-acrylonitrile (SAN).

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
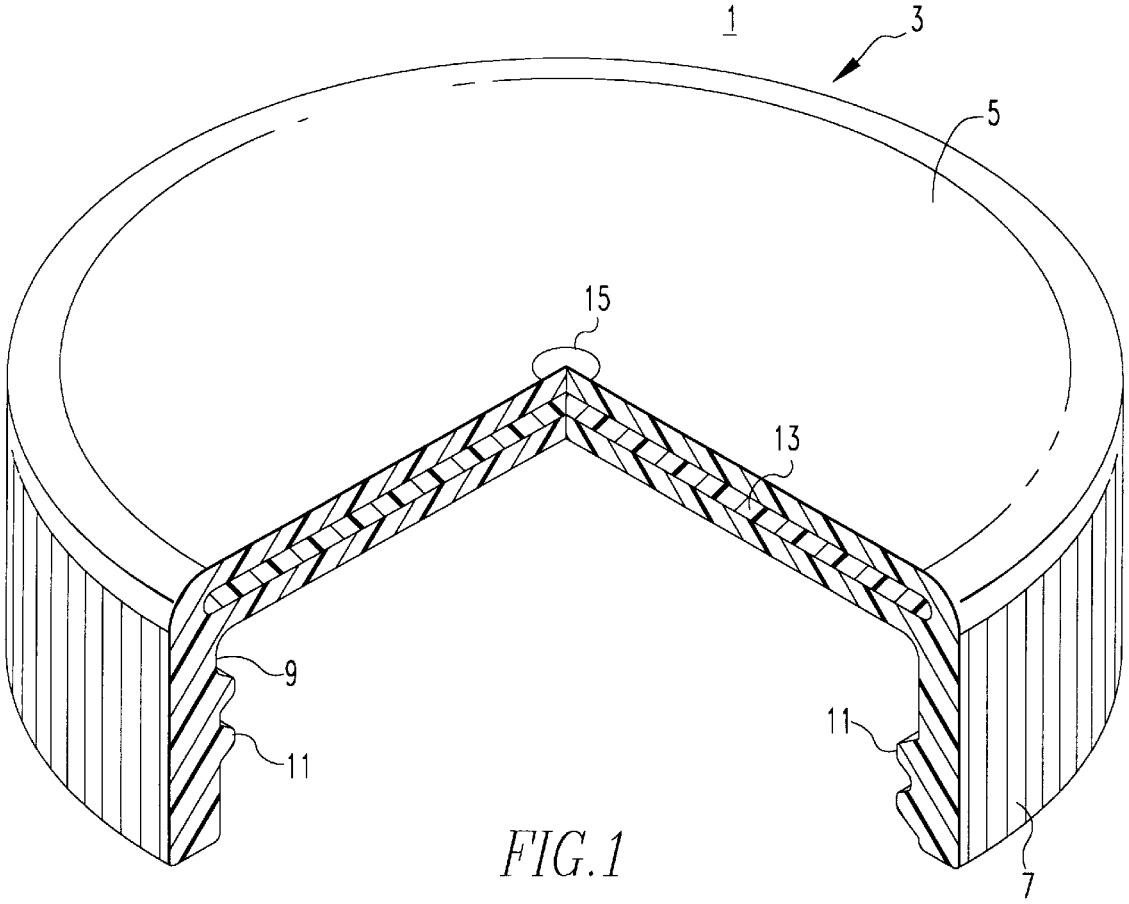
FIG. 1 is an isometric view, with part cut away, of a closure in accordance with the invention.

FIG. 1 illustrates a closure 1 in accordance with the invention. This closure 1 includes a molded plastic cap 3 having an end wall 5 and a skirt 7 extending axially around the periphery of the end wall. The inner surface 9 of the skirt 7 is provided with container engagement members such as threads 11.

The closure 1 also includes a barrier member 13 fully embedded in the cap. In the embodiment illustrated in FIGS. 1 and 2, this barrier member 13 extends across the end wall 5. As previously mentioned, by fully embedded, it is meant that the barrier member is substantially covered all around by the plastic material from which the cap is molded.

The cap 3 with its integral end wall 5 and skirt 7 is co-injected with the barrier member 13. The plastic cap is molded from a readily available and commonly used material such as preferably polypropylene although other inexpensive resins such as high density polyethylene can be used. The barrier member 13 is molded of a material which is substantially impermeable to gases such as air and separately nitrogen, oxygen and carbon dioxide. Preferably, the material also forms a barrier to water vapor and is resistant to the transmission of aromas and other vapors. Examples of suitable barrier materials are: polyvinylidene chloride copolymer (PVDC), ethylene vinyl alcohol copolymer (EVOH), ethylene vinyl acetate (EVA), and nylon while the cap end wall and skirt are molded of the material selected from a group comprising polypropylene, high density polyethylene, polyethylene terephthalate (PET), and styrene-acrylonitrile (SAN).

The plastic resins for the cap and the barrier are co-extruded. The two materials are sequentially injected through an injection point or gate 15 at the center of the end wall. First, the resin for forming the skirt and the lower surface of the end wall are injected. Then the barrier material is injected. This material spreads across the bottom layer of the end wall with injection terminated before it reaches the outer peripheral surface. The temperature and the pressure of the materials is controlled so that they do not bleed together. Then the injection of the cap material is resumed to complete the encapsulation of the barrier member. The complete encapsulation of the barrier member captures and mechanically secures it within the end wall.

Figure 2:
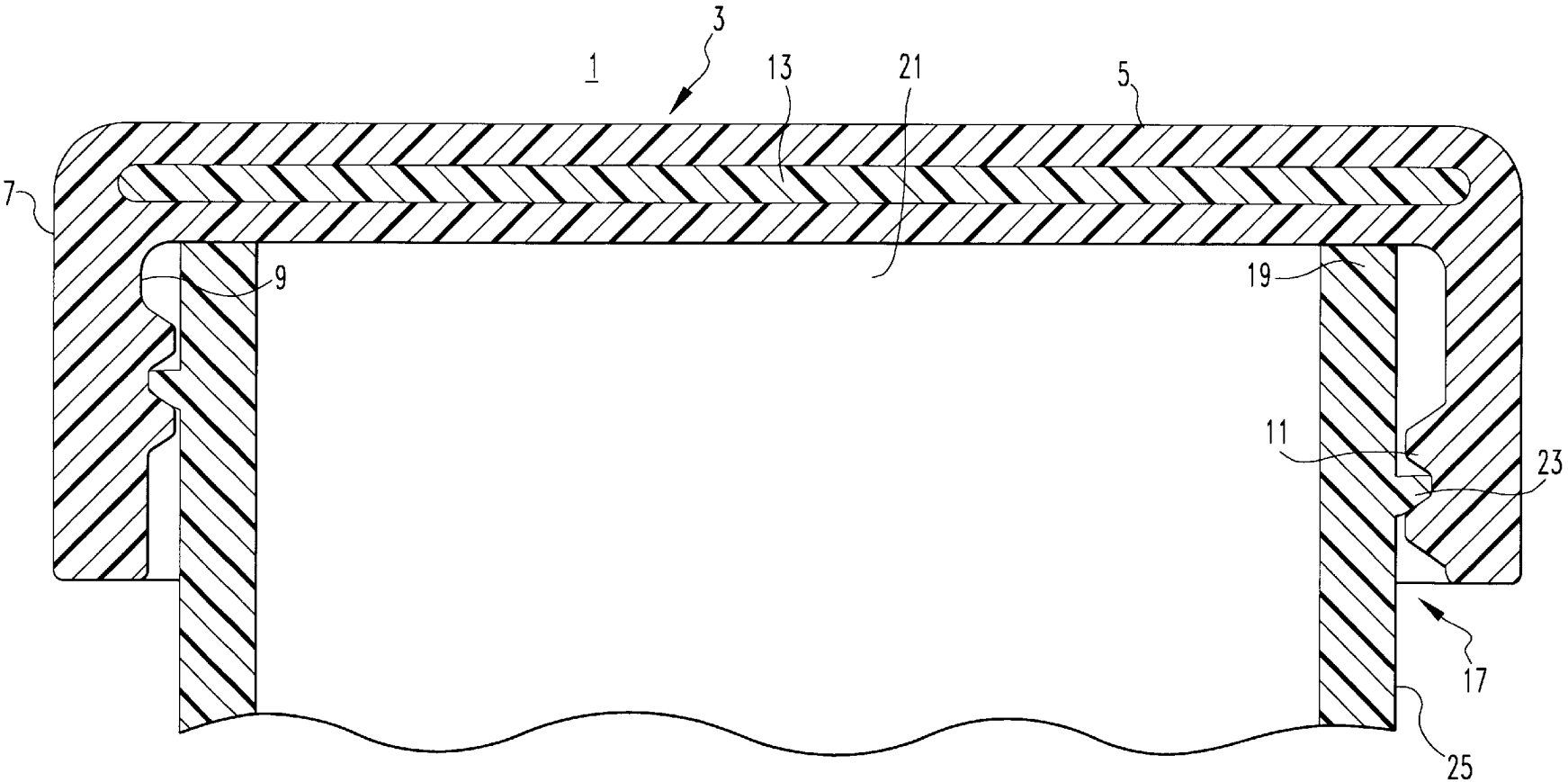
FIG. 2 is a longitudinal cross sectional view through another embodiment of the closure of the invention shown in place on top of a container.

FIG. 2 shows the closure 1 screwed onto a container 17 having a neck 19 which defines a container opening 21. The container neck 19 has closure engaging members such as the threads 23 on an outer surface 25. Other types of closure engaging members such as, for instance, snap rings compatible with the corresponding members on the closure can be used. As illustrated in FIG. 2, it is preferred that the barrier member 13 extends substantially across the end wall 5 to completely overlap the opening 21. In the embodiment of FIG. 2, the barrier member 13 extends radially outward beyond the inner surface 9 of the skirt 7 to provide this overlap.

Figure 3:
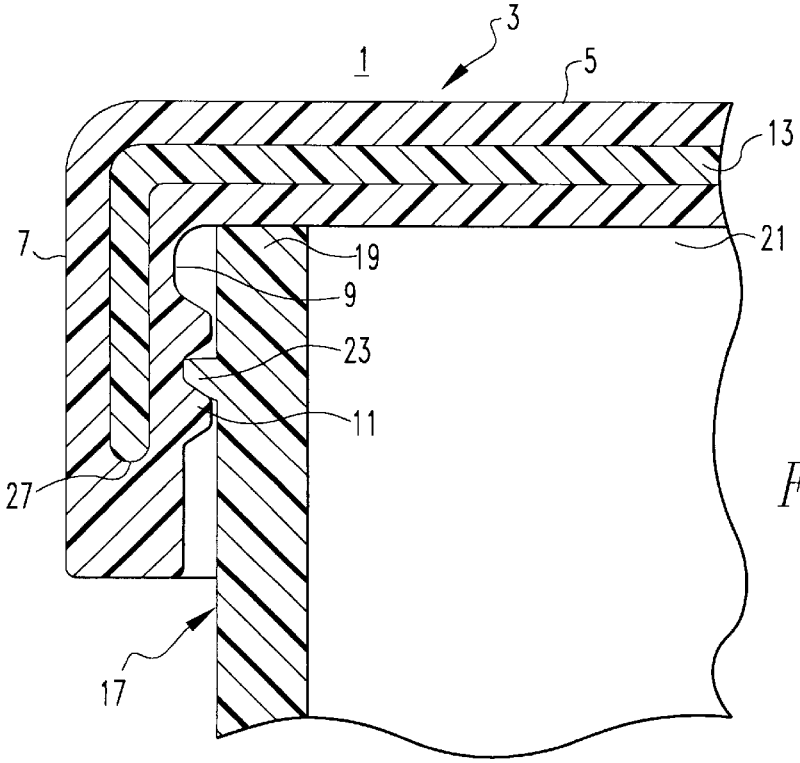
FIG. 3 is a fractional cross sectional view similar to FIG. 2 illustrating another embodiment of the closure in accordance with the invention.

In another embodiment of the invention shown in FIG. 3, the barrier member 13 extends circumferentially within the skirt 7 and axially downward from the end wall for at least part of the axial length of the skirt. Preferably, the barrier extends axially down into the skirt at least so that its lower end 27 is well below the opening 21 on the container 17 when the closure 1 is fully engaged on the container neck 19. In making this embodiment, the viscosity of the resin forming the skirt is controlled so that as it flows outward across the end wall and down the inner wall of the skirt cavity. The barrier resin likewise flows outward, over the first resin, and then down into the skirt, but again its viscosity is such that it forms a vertical extension down the center of the skirt over top of the first resin. Finally, additional first resin with a lower viscosity flows outward over the barrier layer and down into the annular cavity to form the outer surface of the skirt and encapsulate the barrier.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A container closure for engaging a neck of a container defining a container opening and having closure engaging members on an outer surface thereof, said closure comprising:

a molded cap comprising an end wall and an integral skirt extending axially from a periphery of said end wall and having container engaging members on an inner surface for engaging said closure engaging members on said outer surface of said container neck with said end wall closing off said container opening; and a barrier member extending at least across and substantially fully embedded within said end wall.

2. The closure of claim 1 wherein said barrier member extends outward in said end wall radially beyond said inner surface of said skirt while remaining substantially fully embedded within said end wall.

3. The closure of claim 2 wherein said barrier member is molded of a barrier material selected from a group comprising: polyvinylidene chloride copolymer (PVDC), ethylene vinyl alcohol copolymer (EVOH), ethylene vinyl acetate (EVA), and nylon.

4. The closure of claim 3 wherein said end wall and said skirt are molded of a material selected from a group comprising: polypropylene, high density polyethylene, polyethylene terephthalate (PET), and styrene-acrylonitrile (SAN).

5. The closure of claim 4 wherein said barrier member further extends circumferentially within and at least partially axially along, and is substantially fully embedded in said skirt.

6. The closure of claim 2 wherein said end wall and said skirt are molded of a material selected from a group comprising:

polypropylene, high density polyethylene, polyethylene terephthalate (PET), and styrene-acrylonitrile (SAN).

* * * * *

US006095359C1

(12) EX PARTE REEXAMINATION CERTIFICATE (10850th)

United States Patent

Richmond

(10) Number: US 6,095,359 C1

(45) Certificate Issued: Apr. 21, 2016

(54) MOLDED PLASTIC CONTAINER CLOSURE WITH FULLY EMBEDDED BARRIER

(75) Inventor: Thomas Michael Richmond, Evansville, IN (US)

(73) Assignee: RXI PLASTICS, INC., Stamford, CT (US)

Reexamination Request:
No. 90/013,044, Oct. 25, 2013

Reexamination Certificate for:

| | |
|---|---|
| Patent No.: | **6,095,359** |
| Issued: | **Aug. 1, 2000** |
| Appl. No.: | **09/405,614** |
| Filed: | **Sep. 24, 1999** |

(51) Int. Cl.

| | |
|---|---|
| ***B65D 53/00*** | (2006.01) |
| ***B65D 41/04*** | (2006.01) |
| ***B65D 53/06*** | (2006.01) |

(52) U.S. Cl.
CPC ..... *B65D 41/0435* (2013.01); *B65D 53/06* (2013.01)

(58) Field of Classification Search
None
See application file for complete search history.

(56) References Cited

To view the complete listing of prior art documents cited during the proceeding for Reexamination Control Number 90/013,044, please refer to the USPTO's public Patent Application Information Retrieval (PAIR) system under the Display References tab.

*Primary Examiner* — Aaron J Lewis

(57) ABSTRACT

A plastic closure has a gas impermeable barrier member co-extruded with and substantially fully embedded within the cap so that the barrier member is mechanically captured within the molded cap. The substantially fully embedded barrier member extends at least across the end wall and can also extend circumferentially within and at least partially axially down the skirt from the end wall.

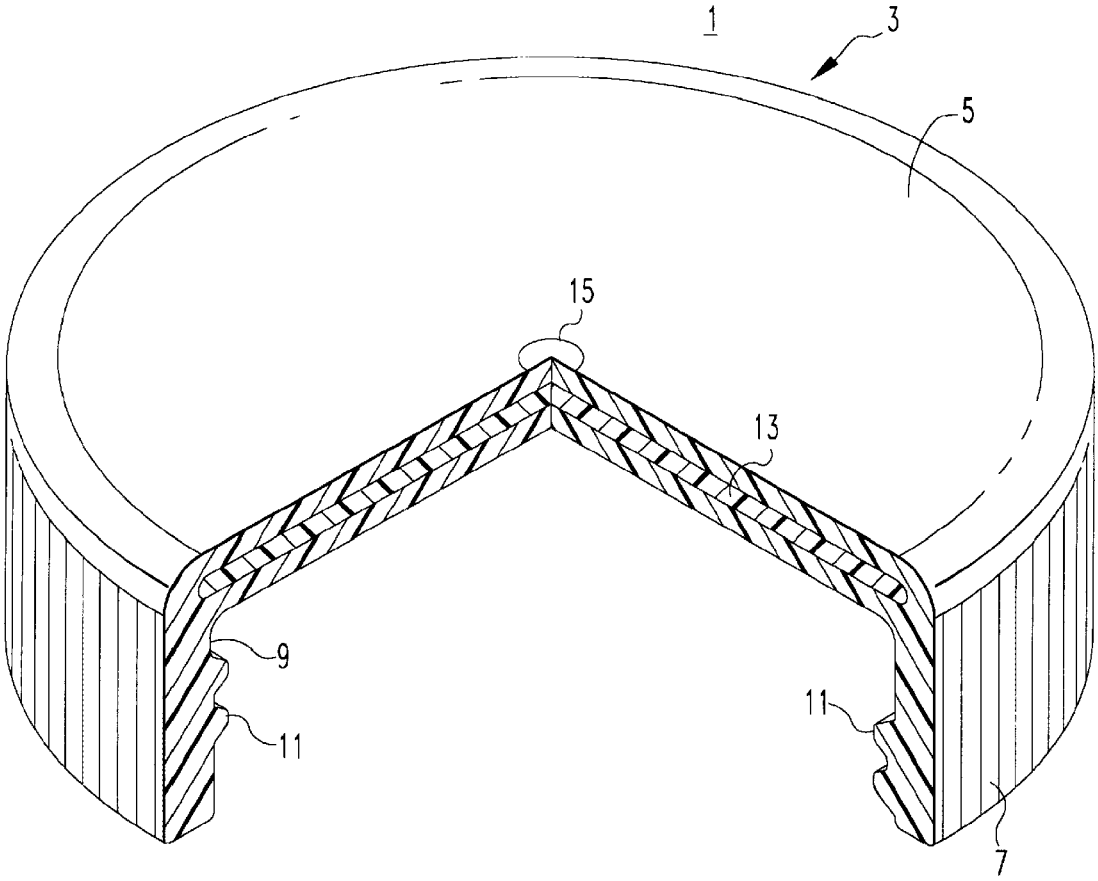

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-6 are cancelled.

* * * * *